United States Patent [19]

Stephens et al.

[11] 4,012,296

[45] Mar. 15, 1977

[54] ELECTRODE FOR ELECTROLYTIC PROCESSES

[75] Inventors: Donald E. Stephens; Tilak V. Bommaraju, both of Grand Island, N.Y.

[73] Assignee: Hooker Chemicals & Plastics Corporation, Niagara Falls, N.Y.

[22] Filed: Oct. 30, 1975

[21] Appl. No.: 627,428

[52] U.S. Cl. ..... 204/98; 204/242; 204/252; 204/290 R; 204/291

[51] Int. Cl.[2] ..... C25B 11/06; C25B 11/10; C25B 13/08; C25B 1/46

[58] Field of Search ..... 204/98, 242, 252, 290 F

[56] References Cited

UNITED STATES PATENTS

| | | | |
|---|---|---|---|
| 3,485,744 | 12/1969 | Schaffner | 204/290 R |
| 3,657,102 | 4/1972 | Keith et al. | 204/290 F |
| 3,718,551 | 2/1973 | Martinsons | 204/98 |
| 3,732,157 | 5/1973 | DeWitt | 204/268 |
| 3,770,613 | 11/1973 | Chisholm | 204/290 R |
| 3,778,307 | 12/1973 | Beer | 204/290 F |
| 3,801,490 | 4/1974 | Welch | 204/290 F |
| 3,810,770 | 5/1974 | Bianchi et al. | 106/286 |

*Primary Examiner*—F.C. Edmundson
*Attorney, Agent, or Firm*—Peter F. Casella; Howard M. Ellis

[57] ABSTRACT

An electrode, for use in electrolytic processes, especially as an anode for use in the electrolysis of aqueous solutions of alkali metal halides, comprises a valve metal substrate coated on at least a portion of the surface thereof with a mixed oxide of hafnium and ruthenium wherein the molar ratio of ruthenium:hafnium is from about 0.25 to about 4.0.

10 Claims, No Drawings

ELECTRODE FOR ELECTROLYTIC PROCESSES

BACKGROUND OF THE INVENTION

This invention relates to electrodes for use in electrolytic processes and in particular for use as an anode in processes involving the electrolysis of aqueous solutions of alkali metal halides.

A variety of materials have been tested and used as chlorine anodes in electrolytic cells. In the past, the material most commonly used for this purpose has been graphite. However the problem associated with the use of graphite are several. The chlorine overvoltage of graphite is relatively high, in comparison for example with the platinum group metals. Furthermore, in the corrosive media of an electrolytic cell, graphite wears readily, resulting in substantial loss of graphite and the ultimate expense of replacement as well as continued maintenance problems resulting from the need for frequent adjustment of spacing between the anode and cathode as the graphite wears away. More recently a variety of dimensionally stable anodes comprising a coating of a platinum group metal oxide on a conductive substrate have been developed and used in chlor-alkali cells. Anodes of this type provide excellent electrocatalytic properties as well as a considerably lower wear rate then graphite and are used extensively for the electrolysis of brines. However, the cost of platinum group metal oxides is relatively high and, although the wear rate of such materials is relatively low compared with that of graphite, some wearing away does occur during normal cell operation with attendant loss of the expensive platinum group metal oxide. Efforts to minimize the amount of platinum group metal oxide employed in such anodes have resulted in the development of various anode coating compositions comprising a mixture of a platinum group metal oxide and a non-platinum group metal material. Among these are anode coating compositions comprising a platinum group metal oxide in admixture with one or more other metal oxides such as an oxide of tin, titanium, tantalum or other. Anode coating compositions of this type require lesser amounts of the expensive platinum group metal-oxide while retaining at least some of the excellent electrocatalytic properties or other advantages of these materials. Among the important properties to be considered in such anode coating compositions are the compatability of the materials, the stability of the composition in the anode environment of an electrolytic cell, and the electrocatalytic characteristics of the composition, as compared with the platinum group metal oxide alone.

Therefore it is an object of this invention to provide improved electrodes, especially useful as anodes in electrolytic processes. It is a further object to provide platinum group metal oxide anodes wherein the amount of platinum group metal oxide required is substantially reduced without an attendant diminution of electrocatalytic and other advantageous characteristics. It is a still further object to provide such anodes comprising a compatible combination of oxides of a platinum group metal and a non-platinum group metal. It is a further object to provide a novel method and electrolytic cell apparatus for the electrolysis of brines. These and other objects and advantages of this invention will become apparent from the following description.

STATEMENT OF THE INVENTION

This invention provides a novel electrode, especially suited for use as a anode in chlor-alkali cells; the novel electrode comprising a valve metal substrate having adhered thereto and extending over at least a portion of the surface thereof, a coating consisting essentially of a mixed oxide of hafnium and ruthenium wherein the molar ratio of ruthenium: hafnium is about 0.25 to about 4.0. Electrodes of this type, when employed as anodes in electrolytic cells, exhibit a high degree of durability in addition to the relatively low overvoltage characteristics of a platinum group metal oxide, making them well suited for use as anodes in the electrolytic production of chlorine from brine as well as for use as anodes in the electrolytic production of chlorates, such as sodium chlorate. Thus, in a further aspect, this invention relates to an electrolytic cell comprising an anode and a cathode wherein the anode comprises a valve metal substrate having adhered thereto and covering at least a portion of the surface thereof, a coating consisting essentially of a mixed oxide of ruthenium and hafnium wherein the molar ratio of ruthenium:hafnium is about 0.25 to about 4.0.

The valve metal substrate which forms the inner or base component of the electrode may be titanium, tantalum, niobium or zirconium or alloys thereof. The valve metals are well known for their tendency to form an inert protective oxide film upon exposure to an anodic environment. The preferred valve metal, based on cost and availability as well as electrical and chemical properties is titanium. The conductivity of the substrate may be improved, if desired, by providing a central core of a highly conductive metal such as copper. In such an arrangement the core is electrically connected to, and completely protected by, the valve metal substrate.

The oxide coating that is applied to the surface of the valve metal substrate consists essentially of an oxide or oxides of hafnium and ruthenium. We have found that the hafnium and ruthenium oxide(s) in the coating compositions of this invention are compatible over a wide range of compositions, as a mixed oxide composition that is extremely resistant to dissolution or deterioration in the anode environment of a chlor-alkali cell. The oxide coating of ruthenium and hafnium is a rutile form wherein hafnium is present as a replacement for ruthenium in the lattice structure. In addition, some hafnium oxide and ruthenium oxide may also be present as discreet phases. Thus the term "mixed oxide of ruthenium and hafnium" as employed herein is intended to include compositions wherein hafnium is present as a replacement for ruthenium in a rutile lattice structure as well as those wherein some hafnium oxide and ruthenium oxide may also be present as a mixture of discreet phases.

The mixed oxide coating may be adherently formed on the surface of a valve metal substrate by various methods. Prior to the application of the coating the substrate is preferably chemically cleaned, for example, by degreasing and etching the surface in a suitable acid, such as oxalic acid. A preferred method of forming the coating comprises applying to the surface of the valve metal substrate a solution of appropriate thermally decomposable salts, and drying and heating in an oxidizing atmosphere such as oxygen or air. The salts that may be employed include, in general, any thermally decomposable salt or ester of hafnium and ruthenium. Typical salts or esters include, for example chlorides, nitrates resinates, alkyl esters, amines and the like. The solution of thermally decomposable salts containing, for example a salt of hafnium and a salt of ruthenium, mixed in the desired proportions, may be applied to the clean surface of the substrate by painting, brushing dipping, rolling, spraying or other method. The coating is then dried at a relatively low temperature, for example, from about room temperature to about 200° Celsius to evaporate the solvent and heated at a higher temperature, such as 250° to 800° Celsius in an oxidizing atmosphere to convert the compounds to an oxide form. The procedure may be repeated as many times as necessary to achieve a desired coating weight or thickness. The final coating weight may vary considerably, but is preferably in the range of about 0.05 to 5.0 milligrams per square centimeter.

In the electrolytic cell apparatus of this invention, the cathode may be formed of an electrically conductive material which resistant to attack under the conditions of electrolysis. Thus, for example, a cathode of graphite, iron, steel, or other electrically conductive resistant material may be employed. Furthermore, the anode, as described hereinabove, and the cathode may be separated by a porous diaphragm, such as an asbestos diaphragm, or by a permselective membrane diaphragm to provide a control of the flow of fluids as well as ionic and molecular migration between the anode compartment and cathode compartment during electrolysis. Especially preferred for this purpose is a cation-active permselective membrane diaphragm substantially impervious to liquids and gases and composed essentially of a hydrolyzed co-polymer of tetrafluoroethylene and a sulfonated perfluorovinyl ether having the formula $$FSO_2CF_2CF_2OCF(CF_3)CF_2OCF{=}CF_2$$

the co-polymer having an equivalent weight of from about 900 to about 1600, and preferably about 1100 to about 1400. Co-polymers of the character referred to are prepared as disclosed in U.S. Pat. No. 3,282,875, by reacting, at a temperature below about 110° Celsius, a perfluorovinyl ether of the formula $$FSO_2CF_2CF_2OCF(CF_3)CF_2OCF{=}CF_2$$

with tetrafluoroethylene in an aqueous liquid phase, preferably at a pH below 8, and in the presence of a free radical initiator such as ammonium persulfate, and subsequently hydrolyzing the acyl fluoride groups to the free acid or salt from by conventional means.

The following specific examples will serve to further illustrate this invention. The examples describe the preparation of the electrodes and the performance of the electrodes as anodes in the electrolysis of brine. It is to be understood, however, that the specific details of the examples are presented for purposes of illustration and are not to be construed as a limitation on the invention. In the examples, unless otherwise indicated, all parts and percentages are by weight and all temperatures are in degrees Celsius.

EXAMPLE 1 — PREPARATION OF ELECTRODE

A. A titanium plate was prepared by immersion in hot oxalic acid to etch the surface, then washed and dried. A solution of 8.7 parts of ruthenium trichloride and 16.52 parts of hafnium tetrachloride in 200 parts of water was prepared and brushed onto the surface of the titanium substrate. The coated substrate was dried at room temperature (about 24° C) for 1–2 minutes then fired in air at 550° C for 5 minutes to convert the metal chlorides to an oxide form. The procedure was repeated four additional times to increase the coating weight of the electrode. Following the final coating, the coated titanium plate was fired in air at 550° C for 15 minutes. The final coating weight was 0.58 milligrams per square centimeter.

An x-ray fluorescence scan of the oxide coating indicated a molar ratio of ruthenium:hafnium of about 0.33, consistent with the molar proportions of ruthenium and hafnium in the aqueous coating solution. X-ray diffraction analysis indicated the formation of a rutile structure which may be characterized by the formula $Ru_{.25}HF_{.75}O_2$.

B. An electrode was prepared following the procedure of Example 1A except that the aqueous coating solution contained 15.43 parts of ruthenium trichloride and 9.69 parts of hafnium tetrachloride (equimolar proportions) in 200 parts of water.

The final coating weight was 0.31 milligrams per square centimeter. Analysis of the oxide coating indicated a ratio of ruthenium:hafnium of about 1.0.

C. The procedure of Examples 1A and 1B was repeated except that the aqueous coating solution contained 20.73 parts of ruthenium trichloride and 4.32 parts of hafnium tetrachloride in 200 parts of water. The final coating weight was 0.47 milligrams per square centimeter. Analysis of the oxide coating indicated a ratio of ruthenium:hafnium of about 3.0.

EXAMPLE 2 — CHLORINE CELL TEST

The electrodes prepared according to Example 1 were tested as anodes in an electrolytic cell containing sodium chloride brine having a strength of 5 molar sodium chloride and maintained at 95° C. After saturation with chlorine gas, the pH of the anolyte was adjusted to about 3.5 to 4.5 by addition of sodium hydroxide. The electrochemical behavior of the anodes is set forth in the following table:

| Anode | Overvoltage at current 0.3 ma/cm² | (millivolts) density of 0.5 ma/cm² | Exchange current Density $i_o$ (milliamperes) |
|---|---|---|---|
| Example 1A | 110 | 132 | 0.98 |
| Example 1B | 76 | 100 | 1.71 |
| Example 1C | 62 | 66 | 4.91 |

EXAMPLE 3 — CHLORINE CELL TEST AT VARIOUS pH LEVELS

An electrode prepared according to Example 1B was further tested to determine effectiveness as an anode for the electrolysis of brine at various pH levels. The electrode was installed as an anode in an electrolytic cell containing an aqueous solution of sodium chloride having strength of 5 molar sodium chloride and maintained at 95° C. After saturation with chlorine gas the pH of the anolyte was adjusted by addition of sodium hydroxide. The electrochemical behavior of the anode at various pH levels is set forth in the following table:

| pH | Overvoltage (mv) at current density of 0.3 amperes | 0.5 amperes | Exchange current Density ($i_o$) (milliamperes) |
|---|---|---|---|
| 7.0 | 68 | 80 | 1.55 |
| 4.75 | 80 | 90 | 1.84 |
| 2.65 | 86 | 100 | 1.68 |
| 1.9 | 100 | 120 | 0.76 |

EXAMPLE 4 — MEMBRANE CELL TEST

The anode of Example 1C was further tested in a cell wherein the anode and cathode were separated by a permselective membrane and the cell was operated under conditions similar to those encountered in commercial chlor-alkali cells.

A. A cation-active permselective membrane was prepared in the following manner: A film of a copolymer of tetrafluoroethylene and a sulfonated perfluorovinyl ether, characterized by the formula $$FSO_2CF_2CF_2OCF(CF_3)CF_2OCF{=}CF_2$$

and having an equivalent weight of about 1100, was prepared according to the procedure of U.S. Pat. No. 3,282,875. The copolymer film was conditioned for use by soaking in boiling water for about 16 hours to hydrolyze the sulfonyl fluoride groups to free sulfonic acid. The membrane, thus prepared was a 10 mil thick film of a hydrolyzed copolymer of tetrafluoroethylene and sulfonated perfluorovinyl ether.

The anode of Example 1C was installed and tested as an anode in a chlorine cell having a steel cathode separated from the anode by a cationic membrane, prepared as described above. The anode compartment was supplied with preheated brine having a composition of about 350 grams/liter NaCl and a pH of about 5.0. The cell temperature was maintained at about 95° C. The test was conducted at a constant current density of 500 ma/cm$^2$. The anode exhibited an overvoltage of 66 millivolts. The cell was operated under these conditions for a period of 15 days. No degradation or dissolution of the anode was detected and the overvoltage remained essentially constant during the test.

What is claimed is:

1. An electrode comprising a valve metal substrate having adhered thereto and extending over at least a portion of the surface thereof a coating consisting essentially of a mixed oxide of ruthenium and hafnium wherein the molar ratio of ruthenium:hafnium is from about 0.25 to about 4.0.

2. An electrode according to claim 1 wherein the valve metal substrate is titanium.

3. An electrode according to claim 2 wherein the molar ratio of ruthenium:hafnium is from about 0.3 to about 3.0.

4. An electrolytic cell for the electrolysis of aqueous solutions of alkali metal halides which comprises an anode and a cathode, said anode comprising a valve metal substrate having adhered thereto and extending over at least a portion of the surface thereof, a coating consisting essentially of a mixed oxide of ruthenium and hafnium wherein the molar ratio of ruthenium:hafnium is from about 0.25 to about 4.0.

5. An electrolytic cell according to claim 4 wherein said substrate is titanium.

6. An electrolytic cell according to claim 5 wherein the anode and cathode are separated by a diaphragm.

7. An electrolytic cell according to Claim 5 wherein the anode and cathode are separated by a cation-active permselective membrane diaphragm substantially impervious to liquids and gases and composed essentially of a hydrolyzed copolymer of tetrafluoroethylene and a sulfonated perfluorovinyl ether having the formula $$FSO_2CF_2CF_2OCF(CF_3)CF_2OCF{=}CF_2$$

said copolymer having an equivalent weight of from about 900 to about 1600.

8. In a method of electrolyzing aqueous solutions of an alkali metal chloride wherein chlorine is liberated at the anode, the improvement which comprises using as said anode, a composite structure comprising a valve metal substrate having adhered thereto and extending over at least a portion of the surface thereof, a coating consisting essentially of a mixed oxide of ruthenium and hafnium wherein the molar ratio of ruthenium:hafnium is from about 0.25 to about 4.0.

9. A method according to claim 8 wherein said valve metal substrate is titanium.

10. A method according to claim 9 wherein the molar ratio of ruthenium:hafnium is from about 0.3 to about 3.0.

* * * * *